US005081341A

United States Patent [19]

Rowe

[11] Patent Number: 5,081,341

[45] Date of Patent: Jan. 14, 1992

[54] ELECTRICAL HEATING ELEMENT FOR USE IN A PERSONAL COMFORT DEVICE

[75] Inventor: William M. Rowe, De Kalb, Miss.

[73] Assignee: Specialty Cable Corp., Wallingford, Conn.

[21] Appl. No.: 483,908

[22] Filed: Feb. 22, 1990

Related U.S. Application Data

[63] Continuation of Ser. No. 237,728, Aug. 29, 1988, Pat. No. 4,910,391.

[51] Int. Cl.[5] ..... H05B 1/02

[52] U.S. Cl. ..... 219/505; 219/504; 219/212; 219/549; 307/326; 338/63

[58] Field of Search ..... 219/212, 494, 505, 504, 219/497, 501, 506, 508, 510, 544, 549; 307/326, 309; 338/61-63

[56] References Cited

U.S. PATENT DOCUMENTS

| | | | |
|---|---|---|---|
| 874,023 | 12/1907 | McElroy | 338/62 |
| 4,436,986 | 3/1984 | Carlson | 219/505 |
| 4,503,322 | 3/1985 | Kishimoto et al. | 219/505 |
| 4,575,620 | 3/1986 | Ishii et al. | 219/212 |
| 4,607,154 | 8/1986 | Mills | 219/212 |
| 4,661,690 | 4/1987 | Yamamoto et al. | 219/505 |

OTHER PUBLICATIONS

"Electrical Appliance Circuit to Eliminate Potentially Dangerous EMF Effect" Jan. 1990 pp. 36-40 T. Gross.

"Stratagies to Reduce Population Exposure to 60Hz EMF" 12-1984 Carnagie Mellon University-pp. 1-110.

"Stratagies to Reduce Population Exposure to 60Hz EM Fields", 12-1984, Carnagie Mellon University, Final Report 219/212.

*Primary Examiner*—Mark H. Paschall

*Attorney, Agent, or Firm*—St. Onge Steward Johnston & Reens

[57] ABSTRACT

A heated comfort product such as an electrical blanket having an elongate electrical resistance element is connected in a particular manner to an AC power line by connecting the ends of conductors used in the element at a common end to respective AC power lines so as to achieve reduced or non-detectable electromagnetic and/or electrostatic radiating fields from the comfort product.

11 Claims, 3 Drawing Sheets

CONNECTION OF RESISTANCE TYPE WIRE

CONNECTION OF PTC TYPE WIRE

ELECTRICAL HEATING ELEMENT FOR USE IN A PERSONAL COMFORT DEVICE

This is a continuation of copending application Ser. No. 07/237,728 filed on Aug. 29, 1988, now U.S. Pat. No. 4,910,391.

BACKGROUND OF THE INVENTION

1. Field of the Invention

The present invention relates to an electrical heating apparatus and more particularly to an electrical heating apparatus in which the electromagnetic fields and electrostatic fields associated with personal heating devices having positive temperature coefficient bodies are reduced to protect the user against health hazards associated with electromagnetic fields and electrostatic fields.

2. General Background

Electrically heated personal comfort, or medical aid, devices typically include electrical resistance heating body threaded between a pair of fabric covers. Heat is generated and supplied to the user when electrical energy is applied across a heater wire which is woven with pockets or slots into which the resistance heating body is threaded. Conventionally, the temperature of the personal comfort device is controlled by a suitable controller connected to the resistance heating body.

An improvement to the personal comfort heating device is characterized by a heating portion of positive temperature coefficient, hereinafter termed PTC, material which is included in the resistance heating body. For examples of such devices see Sanford et al. U.S. Pat. No. 3,410,984; and, Crowley U.S. Pat. No. 4,271,350, U.S. Pat. No. 4,309,596 and U.S. Pat. No. 4,309,597.

However, the basic material from which the PTC heating portion is formed may be subject to conductor breakage. Sopory in U.S. Pat. No. 4,334,351 discloses extruding a second polymeric PTC material having great flexibility over an underlying PTC composition which is relatively rigid in order to prevent damage to the heating body from flexing, and, prevent conductor breakage. Ishii et al. discloses in U.S. Pat. No. 4,575,620 a heating portion having a positive temperature coefficient which is held in electrical contact with at least one of a first and second conductive bodies and a third conductive body acting as a fusing wire in the event of fracture of the PTC portion. Mills discloses in U.S. Pat. No. 4,577,094 a sensing wire and circuit to shut down a conventional blanket in the event of overheating. Thus, until the present invention, prior patents have been directed toward the personal safety of the user against an overheating failure which are commonly known to cause fires.

However, it has now been found that a more serious danger than that caused by overheating exists. Data as disclosed by D. Carpenter, "Report to the Fourth Annual EEPA Meeting", Bioelectromagnetics Society Newsletter, June 1988, and "Biological Effects of Power Line Fields" Panel's Final Report, New York State Power Lines Project, July 1987, which are incorporated herein, has been found to indicate that electromagnetic fields, and electrostatic fields contribute to tumor growth. Studies as disclosed by B. W. Wilson et al., "Domestic ELF Field Exposure and Peneal Gland Function", Tenth Annual Meeting Abstracts, BEMS, June 1988, which is incorporated herein, have definitely shown a correlation between malfunction of certain portions of the human endocrine system in the presence of conventional personal heating devices having positive temperature coefficient bodies. H. K. Florig et al. discloses in "Electric Field Exposure From Electric Blankets", IEEE Transactions on Power Delivery, April 1987, which is incorporated herein, that significant electric fields are present under electric blankets when heating.

SUMMARY OF THE PRESENT INVENTION

Accordingly, it is an object of the present invention to provide an improved electrical heating element for use in a personal comfort heating device of the type in which the electromagnetic fields and electrostatic fields associated with the electrical heating element of the personal heating devices are reduced to protect the user against health hazards associated with electromagnetic fields and electrostatic fields.

In accordance with this object, it is a further object of the present invention to provide an improved electrical heating element for use in a personal comfort heating device of the type in which the electromagnetic fields and electrostatic fields associated with an electrical heating element having a positive temperature coefficient portion thereof are reduced to protect the user against health hazards associated with electromagnetic fields and electrostatic fields.

In particular, the electrical heating element of the present invention includes a means for enclosing the electromagnetic and electrostatic fields of an electrical current flowing through the electrical heating means so that the electromagnetic fields and electrostatic fields are reduced.

The above objects and other features of the present invention will become apparent from the drawings, the description given herein, and the appended claims.

BRIEF DESCRIPTION OF THE DRAWING

For a further understanding of the nature and objects of the present invention, reference should be had to the following description, taken in conjunction with the accompanying drawings, in which like parts are given like reference numerals and, wherein.

DETAILED DESCRIPTION OF THE PREFERRED EMBODIMENT

Figure 3:
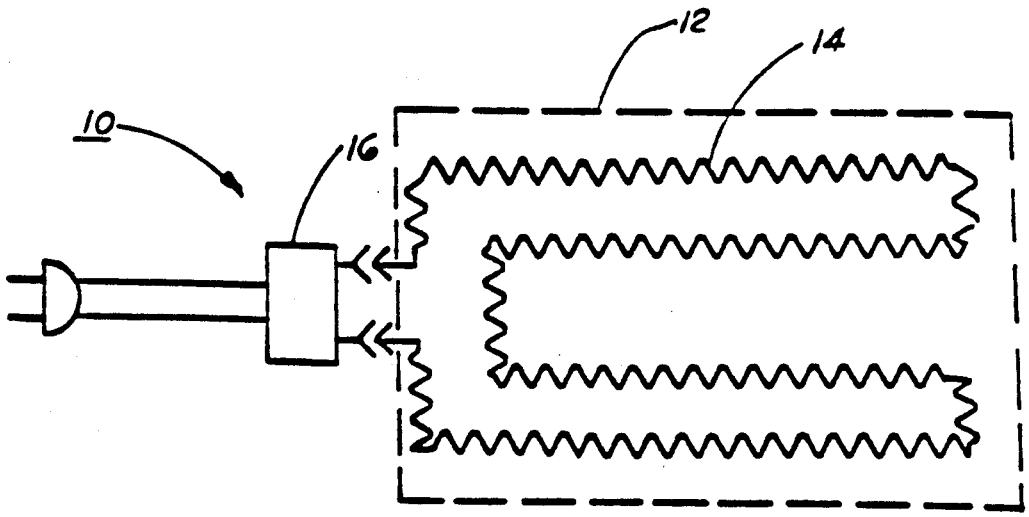
PRIOR ART FIG. 3
FIG. 3 is a schematic representation of a first conventional arrangement for interconnecting the prior resistance heating bodies of FIGS. 1 and 2.
Figure 4:
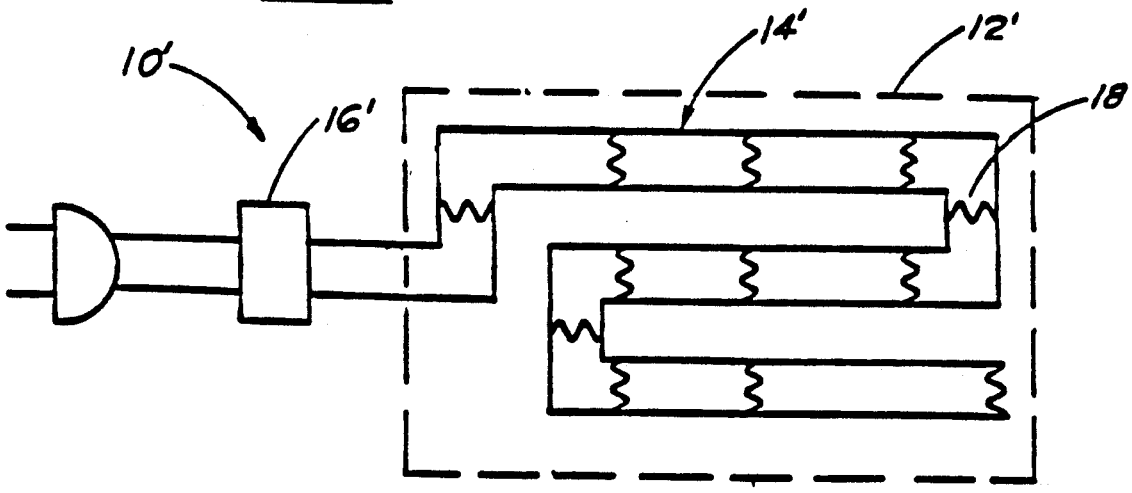
PRIOR ART FIG. 4
FIG. 4 is a schematic representation of a second conventional arrangement for interconnecting the prior resistance heating bodies of FIGS. 1 and 2.
Figure 2:
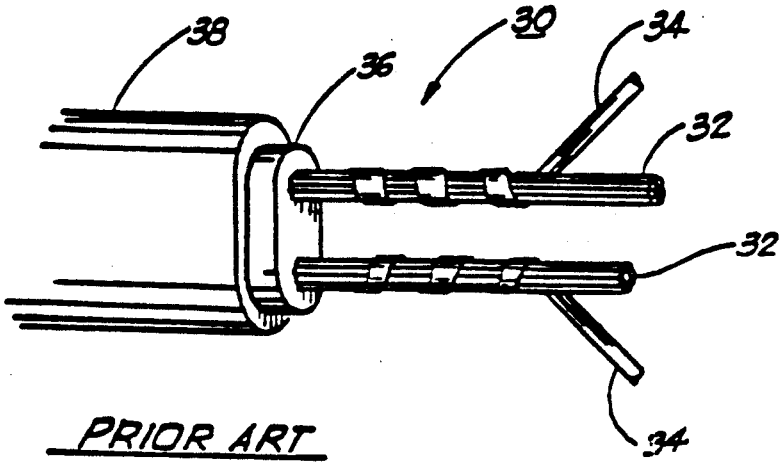
PRIOR ART FIG. 2
FIG. 2 is a cut away side view of a second resistance heating body.

Referring to FIGS. 3 and 4, schematics of a conventional personal comfort device represented by reference numbers 10 and 10', such as an electric blanket, shows a conventional personal comfort device as having an envelope as indicated by reference numerals 12 and 12', and electrical resistance heating elongated body as indicated by reference numerals 14 and 14' and a suitable controller indicated by reference numerals 16 an 16' connected to resistance heating body 14, 14'. Envelope or fabric cover 12, 12' is woven with unshown pockets, or slots, into which heating body 14, 14' is shuttled. Referring specifically to FIG. 2, a schematic representation of a personal comfort device 10' having an electrical resistance heating body 14' that includes a PTC heating portion is shown. The representation as indicated by reference numeral 18 indicates that a personal comfort device having an electric resistance heating body that includes a PTC heating portion are essentially parallel heating devices in which the plastic PTC material is the heater. Included with the personal comfort device is its controller 16'.

Figure 1:
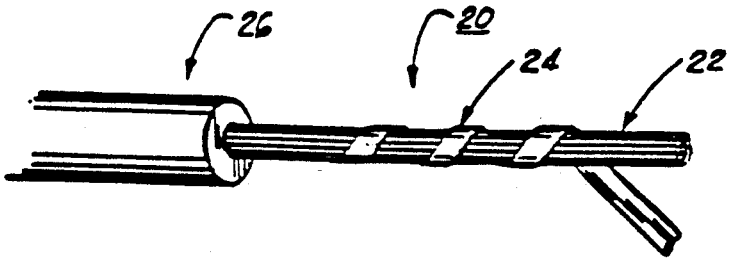
PRIOR ART FIG. 1
FIG. 1 is a cut away side view of a first prior resistance heating body.

FIG. 1 illustrates a prior resistance heating body 20 for use in a conventional personal heating device such as represented by schematic FIGS. 3 and 4. Body 20 includes a fabric core 22 having a plurality of parallel fabric strands, a resistance wire 24 which winds around or spirals about fabric core 22, and a jacket 26 which surrounds core 22 and wire 24. Conventionally, the fabric strands may be of rayon, although dacron, cotton, or any other flexible fibrous nonconductive material may also be used, and jacket 26 in which core 22 and wire 24 are concentrically disposed is typically of polyvinyl chloride, with jacket 26 being extruded over core 22 and wire 24 so that jacket 26 is in electrical contact with wire 24. Typically, wire 24 is copper or cadmium copper resistance wire.

FIG. 2, illustrates a second prior resistance heating body 30 for use in a conventional personal heating device such as represented by schematic FIGS. 3 and 4. Body 30 includes a pair or parallel but spaced fabric cores 32, and a copper wire 34 is wrapped over each fabric core 32. Typically, cores 32 are polyethylene terphthalate where crosslinking is accomplished by electron beam irradiation, with each copper wire 34 and core 32 forming a conductive assembly. The fabric core material of core 32 may be manufactured of rayon, or other fibers, when chemical crosslinking is used. PTC material is extruded over the spaced core and wire assembly to form a jacket 36, and a covering 38 is extruded over the PTC material.

Measurements made on the electromagnetic fields produced by electric blankets manufactured to the schematics of FIGS. 3 and 4, using both conventional non PTC material and PTC material as a jacket have been made, and the results are shown in Table 1 below, along with results from the present invention which is discussed in detail hereafter.

TABLE 1

ELECTROMAGNETIC FIELDS PRODUCED BY ELECTRIC BLANKETS

| Blanket Type | Electromagnetic Field (milligauss) |
|---|---|
| Conventional Resistance | 100 mg to 130 mg on blanket surface |

TABLE 1-continued

ELECTROMAGNETIC FIELDS PRODUCED BY ELECTRIC BLANKETS

Figure 6:
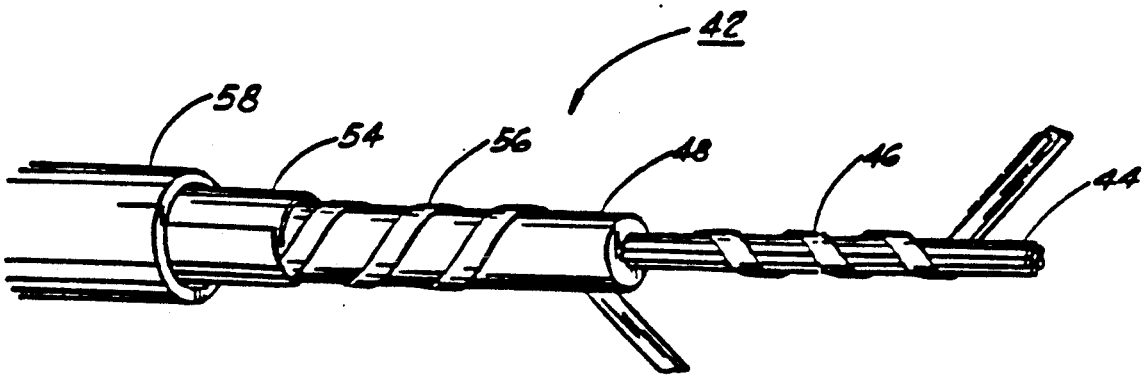
FIG. 6 is a cut away side view of a second embodiment of the resistance electrical heating element according to the present invention.
Figure 8:
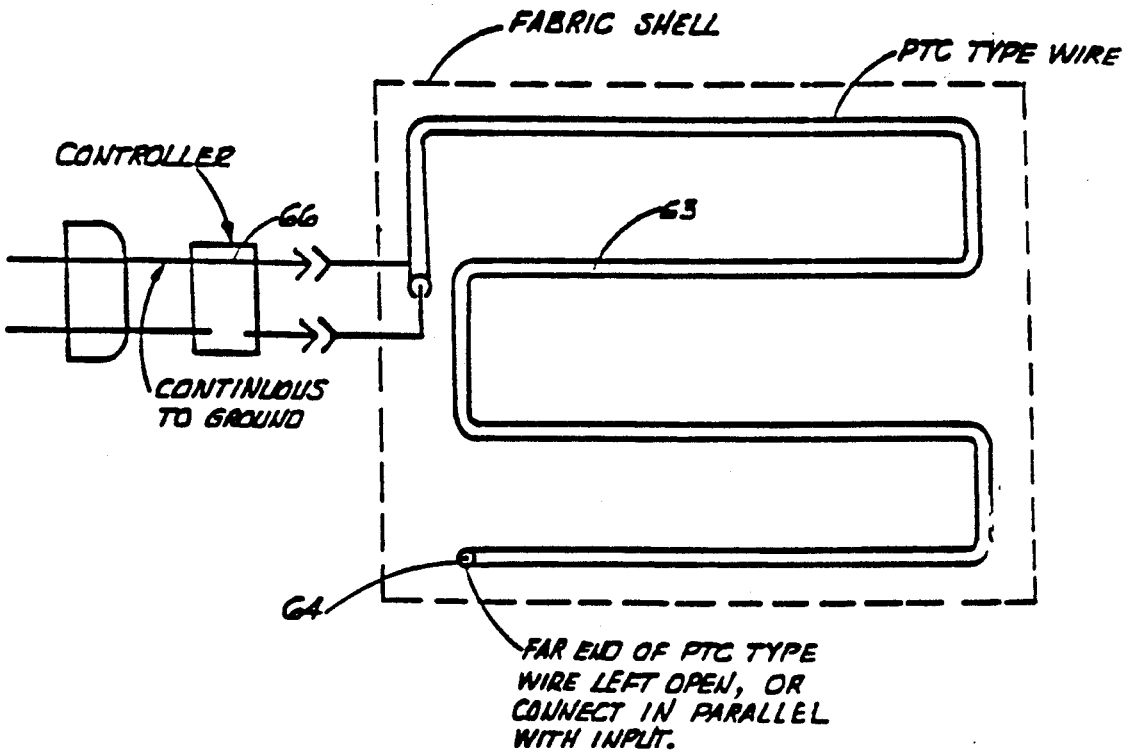

| Blanket Type | Electromagnetic Field (milligauss) |
|---|---|
| PTC type blanket | 120 mg to 150 mg on blanket surface |
| PTC blanket parallel connected | 3 mg to 36 mg on blanket surface |
| Blanket using wire of FIG. 6 connected as shown in FIG. 8 | not detectable |

Figure 5:
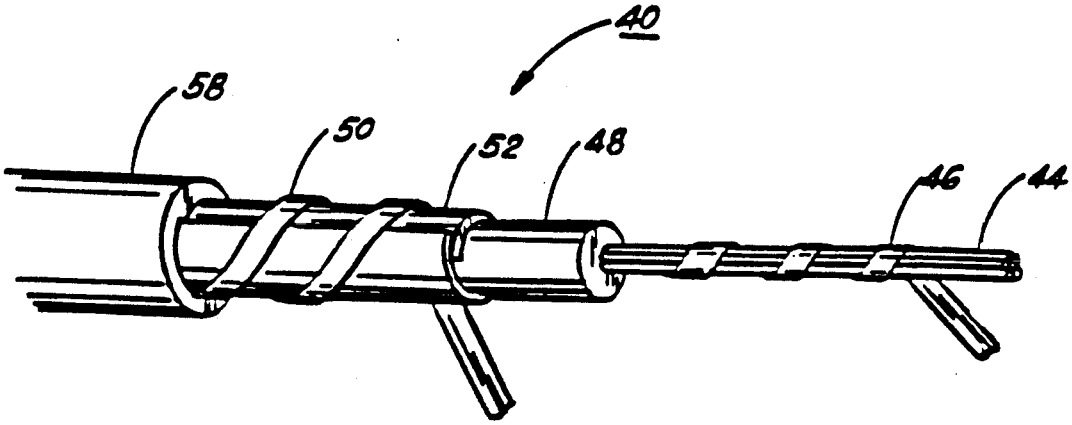
FIG. 5 is a cut away side view of a first embodiment of the resistance electrical heating element according to the present invention.

Referring to FIGS. 5 and 6, the preferred embodiments of the present invention are shown. The present invention is unique in that the present invention addresses a new and distinct form of personal hazard, which indicates that electromagnetic fields, and electrostatic fields contribute to tumor growth. Studies have shown a correlation between malfunction of certain portions of the human endocrine system in the presence of prior personal heating devices having positive temperature coefficient bodies, and it has been shown that significant electric fields are present under electric blankets when heating.

Referring to FIGS. 5 and 6, the preferred embodiments of the electrical heating element shown generally as 40 and 42, and referred to as the first and second embodiments, are shown. Conventionally, electrical heating element 40, 42 includes an electrical heating means for generating heat in proportion to an amount of electrical current flowing therethrough. The heating means includes a fabric core 44 with parallel fabric stands which are similar to core 22 and which provide mechanical strength to heating element 40, 42, a resistance wire 46 similar to wire 24, and a jacket 48. Core 44 may have physical and mechanical characteristics to limit its flexibility, thereby avoiding kinks or bends that might tend to break or knot element 40, 42. Jacket 48 is melt extruded over core 44 and wire 46 so that jacket 48 is in electrical contact with wire 46. As jacket 48 is melt extruded over core 44 and wire 46, core 44 and wire 46 are to be concentrically disposed within jacket 48.

Wire 46, a known resistance heater wire such as copper or cadmium copper, is wrapped around the central core 44 in a helix, and provides heat when electrical current flows therethrough. With either the first or second embodiment of the present invention, jacket 48 may be any suitable known positive temperature coefficient polymer, hereinafter termed simply PTC, and any conductive polymer composition may be used, including that disclosed by Sandford et al. U.S. Pat. No. 3,410,984; G. C. Crowley U.S. Pat. No. 4,271,350, U.S. Pat. No. 4,309,596 and U.S. Pat. No. 4,309,587; J. H. Smuckler U.S. Pat. No. 4,560,524; and U. K. Sopory U.S. Pat. No. 4,334,351. As disclosed by Sandford et al., The PTC material may be a polyethylene which has dispersed therein electrically conductive particles such as carbon black to provide the desired characteristics in which the resistance of the material increases with increasing temperature. Preferably, the PTC composition is one that can be melt shaped, e.g. by extrusion, and may be substantially free from cross linking when the melt fusion takes place. Once the melt fusion has taken place, the PTC composition can if desired be cross linked, e.g. by irradiation as known to the art. The PTC composition may also be relatively rigid, i.e. has low elongation.

With the second embodiment, jacket 48 may also be a material which is not a PTC material such as polyvinyl chloride. Thus, wire 46 should be chosen to provide the correct resistance heat with the electrical current passes through wire 46. Alternatively, with either the first or second embodiment and when jacket 48 is a PTC material, were 46 should be an electrical conductive material which provides good conduction with joule heating less than twenty (20%) percent of the total heat generated in electrical heating element 40, 42.

Included with the first and second embodiments of the present invention is a means disposed over the electrical heating means for enclosing the electromagnetic and electrostatic fields of the electrical current flowing through wire 46. Thus, the present invention provides an improved personal comfort heating device of the type in which the electromagnetic fields and electrostatic fields associated with personal heating devices are reduced to protect the user against health hazards associated with electromagnetic fields and electrostatic fields.

Referring to the first embodiment of FIG. 5, the means for enclosing the electromagnetic and electrostatic fields includes an elongated drain wire 50 and an electrically conductive foil 52, with conductive foil 52 being disposed between jacket 48 and drain wire 50. A preferred material for conductive foil 52 is aluminum foil being disposed between jacket 48 and drain wire 50. Drain wire 50 is helically wrapped approximately five turns per inch or more, up to, but not restricted to 20 turns per inch over foil 52 in an electrically contacting engagement with foil 52 over the longitudinal length of drain wire 50. Wire 50 may be copper, cadmium copper or any other suitable conductive material. Advantageously, with this embodiment, conductive foil 52 may be applied when jacket 48 is melt extruded over core 44 and wire 46. Thus, by applying conductive foil 52 at extrusion, the heat of extrusion will cause foil 52 at bond to jacket 48. Hence, conduction is obtained to conductive foil 52.

Referring to the second embodiment of FIG. 6, the means for enclosing the electromagnetic and electrostatic fields includes an electrically conductive foil 54 and an elongated drain wire 56, with drain wire 56 being disposed between jacket 48 and foil 54. Conductive foil 54 is similar to conductive foil 52, and a preferred material for conductive foil 54 is aluminum foil, due to its low resistance and high conductivity, with drain wire 56 being disposed between jacket 48 and the aluminum foil. Drain wire 56 is helically wrapped approximately 5 turns per inch or more, up to, but not restricted to, 20 turns per inch around jacket 48 in an electrically contacting engagement with jacket 48 over the longitudinal length of drain wire 56. Wire 56 may be copper, cadmium copper or any other suitable conductive material. Following the wrapping of drain wire 56 over jacket 48, a covering of conductive foil 54 is placed over drain wire 56 so that wire 56 lies under foil 54 and between foil 54 and jacket 48, and is in electrical contact with drain wire 56 and jacket 48. Foil 54 can be tape wrapped or cigarette wrapped around wire 56 and jacket 48 by techniques known to the art. Accordingly, this embodiment is to be preferred if conductive foil 54 is to be applied as the final step, rather than with the heat extrusion step of the first embodiment.

An electrically insulating final covering 58 which may be polyvinyl chloride is extruded over conductive foil 54 of FIG. 6 and over drain wire 50 and conductive foil 52 of FIG. 5 to protect the user from possible electrical shocks due to breakage and to protect the embodiments from physical damage.

Figure 7:
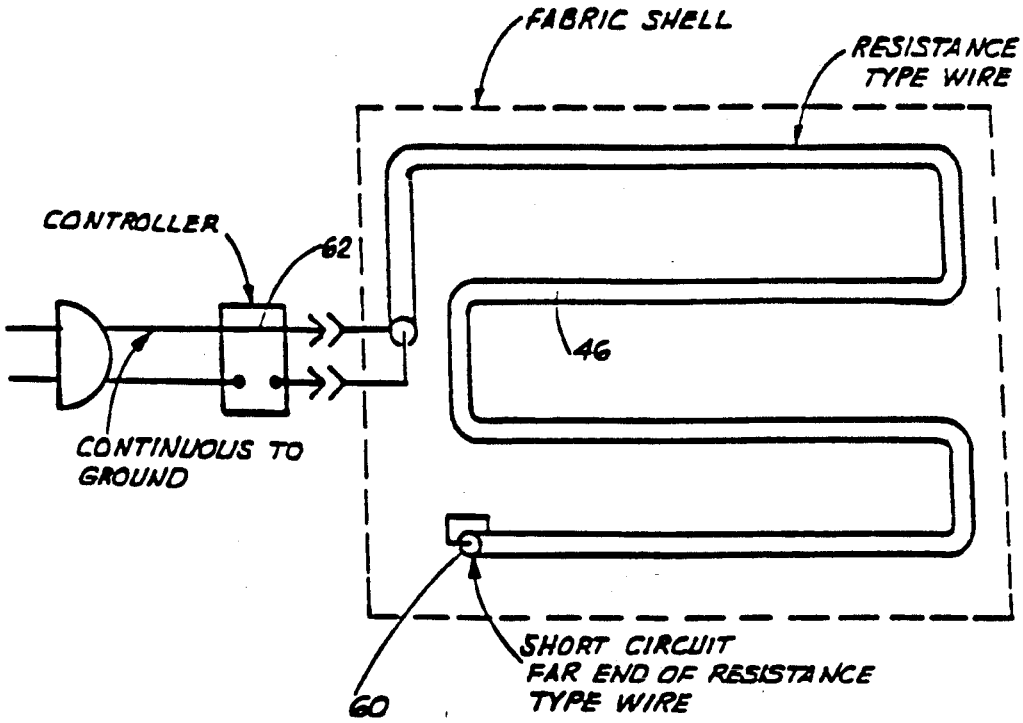
FIG. 7 is a schematic representation of a first method according to the present invention of interconnecting the present invention of the resistance electrical heating element of FIGS. 5 and 6; and, FIG. 8 is a schematic representation of a second method according to the present invention of interconnecting the present invention of the resistance electrical heating element of FIGS. 5 and 6.

The present invention includes the applications of FIGS. 7 and 8. Thus, when electrical heating element 40 or 42 is interconnected in such a manner as shown in FIGS. 7 and 8, the benefits of the invention are obtained. Referring to FIG. 7, an embodiment of electrical heating element 42 which does not have a PTC jacket 48 has its electrically conductive resistance wire 46 short circuited at its free end as indicated by reference numeral 60 to drain wire 46 to provide the advantages of the present invention. Referring to FIG. 8, the embodiments of electrical heating element 42, 44, indicated in the FIGURE by reference numeral 63, which have a PTC jacket 48, have their free end left open as indicated by reference numeral 64, or connected in parallel with the input from controller 66.

Thus, in accordance with the presence invention, a personal heating device is obtained which does not produce hazardous electromagnetic or electrostatic fields. Measurements as presented in Table 1 above made on the electromagnetic fields show that an electric blanket manufactured to the schematics of FIG. 8 and using an electrical heating element 42 of FIG. 6 has a non detectable electromagnetic field. Thus, the present invention provides an improved electrical heating element for use in a personal comfort heating device in which the electromagnetic fields and electrostatic fields associated with the electrical heating element are reduced.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A reduced or non-detectable electromagnetic and/or electrostatic field radiating electric comfort product such as an electric blanket, heating pad or lap warmer and the like and heated by conventional AC power obtained from an electric outlet having a pair of AC power lines, comprising:

an elongate electric heater cable formed with a pair of electrical conductors which are closely spaced to one another inside the cable; said cable having a front end and a terminal end, one of the conductors being helically-wrapped around the other and a positive temperature coefficient material extruded around the other conductor and in electrical contact with both the conductors along their lengths;

means for connecting the pair of AC power lines to the front end of the heater cable; said means connecting one AC power line to one of the electrical conductors at the front end and the other AC power line to the other electrical conductor at the front end so that electric current flows through said closely-spaced conductors in respectively opposite directions along the cable between its front end and its terminal end, so as to substantially reduce the electromagnetic and electrostatic field generated by the electric comfort product when it is heated from the AC power on the AC power lines.

2. The electric heated comfort product as claimed in claim 1 wherein at least one of the electric conductors in the elongate electric heater cable comprises a resistive material.

3. The electric heated comfort product as claimed in claim 1 wherein said pair of electrical conductors are coaxially-arranged.

4. The electric heated comfort product as claimed in claim 1 wherein the one conductor is helically-wrapped with a number of turns that are in the range from approximately five turns per inch to about twenty turns per inch.

5. A reduced or non-detectable electromagnetic and/or electrostatic field radiating electric heated comfort product such as an electric blanket, heating pad or lap warmer and the like and heated by conventional AC power obtained from an electric outlet having a pair of AC power lines comprising:

an elongate electric heater cable formed with first and second spaced-apart electrical conductors arranged in a coaxial relationship;

a non-conductive core;

said first conductor being helically-wrapped in a first direction around the core;

a PTC resistive material extruded around the first conductor and being electrically-coupled to the first conductor along their respective lengths;

said second conductor being helically-wrapped around the PTC resistive material and electrically-coupled thereto along their respective lengths;

an insulating jacket extruded around the second conductor; and a control coupled to connect the AC power lines respectively to the first and second conductors at a common end of the heater cable.

6. The electric heated comfort product as claimed in claim 5 wherein the helical wraps of the second conductor are in the same direction as the helical wraps of the first conductor.

7. The electric heated comfort product as claimed in claim 5 wherein the helical wraps of the second conductor are in an opposite direction to those of the first conductor.

8. The electric heated comfort product as claimed in claim 5 and further including an electrically-conductive foil interposed between the PTC resistive material and said second conductor and wrapped around the PTC resistive material.

9. The electric heated comfort product as claimed in claim 8 wherein said foil is an aluminum foil.

10. The electric heated comfort product as claimed in claim 5 and further including an electrically-conductive foil wrapped around the second conductor and in electrical contact therewith.

11. The electric heated comfort product as claimed in claim 10 wherein said foil is an aluminum foil.

* * * * *